US007362984B2

(12) United States Patent
Eom

(10) Patent No.: US 7,362,984 B2
(45) Date of Patent: Apr. 22, 2008

(54) DUPLEX PRINTING APPARATUS HAVING A DETACHABLE GUIDE FRAME

(75) Inventor: Tae-won Eom, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 178 days.

(21) Appl. No.: 11/292,109

(22) Filed: Dec. 2, 2005

(65) Prior Publication Data

US 2006/0127127 A1 Jun. 15, 2006

(30) Foreign Application Priority Data

Dec. 15, 2004 (KR) ..... 10-2004-0106385

(51) Int. Cl.
*G03G 15/00* (2006.01)

(52) U.S. Cl. ..... 399/110; 399/401

(58) Field of Classification Search ..... 399/110, 399/364, 401, 402, 405

See application file for complete search history.

(56) References Cited

FOREIGN PATENT DOCUMENTS

JP 63-208470 8/1988
JP 10-87139 4/1998
KR 10-0385058 8/2002
KR 10-0412508 10/2003

*Primary Examiner*—Hoang Ngo
(74) *Attorney, Agent, or Firm*—Roylance, Abrams, Berdo & Goodman, L.L.P.

(57) ABSTRACT

A duplex printing apparatus having a main body housing, an image forming part accommodated in the main body housing for forming images, a fixing part for supplying heat and pressure to a paper, and a duplex printing part to reverse the paper passing through the fixing part on a conveyance path and to guide the paper to the image forming part for duplex printing. The duplex printing apparatus further includes a flapper to convert the conveyance path of the paper according to whether a duplex printing operation is set, a discharging roller to discharge the paper from the fixing part, and a guide frame comprising a flapper supporting part to rotatably support the flapper, a discharging roller supporting part to rotatably support the discharging roller, and a guide part to guide the paper, and which is detachably disposed between the fixing part and the duplex printing part in the main body housing for easy removal to provide access to paper jams.

12 Claims, 5 Drawing Sheets

DUPLEX PRINTING APPARATUS HAVING A DETACHABLE GUIDE FRAME

CROSS-REFERENCE TO RELATED APPLICATIONS

This application claims the benefit under 35 U.S.C. §119 (a) of Korean Patent Application No. 10-2004-0106385, filed in the Korean Intellectual Property Office on Dec. 15, 2004, the entire disclosure of which is incorporated herein by reference.

BACKGROUND OF THE INVENTION

1. Field of the Invention

The present invention relates to a duplex printing apparatus. More specifically, the present invention relates to a duplex printing apparatus which provides convenient access for eliminating paper jams with greater ease.

2. Description of the Related Art

Generally, a printing apparatus such as a laser printer or a photocopier, has a duplex printing function which returns a sheet of paper back to an image forming part to print information on both sides of the paper, respectively. An example of such a conventional apparatus is shown in FIG. 1.

Referring to FIG. 1, a configuration and printing process of a conventional duplex printing apparatus is shown, and is described in greater detail below.

A one sided printing process can be illustrated by referring to a conveyance path A in FIG. 1, wherein a paper 15 is picked up from a paper feeding cassette 11 by rotating a pick up roller 17 or is drawn from a paper feeding board through a paper feeding roller 19, and is moved to an image forming part 20 with an end portion of the paper 15 in line while passing a register roller 18. The paper 15 is formed with an image while passing through the image forming part 20, and the image is fixed in a fixing part 30 by passing the paper 15 between a heating roller 31 and a pressure roller 33. The paper 15 is discharged from the fixing part 30 by a discharging roller 35 and an idle roller 37, and is then output to the outside of a main body housing 1 by contacting an upper surface of a flapper 40 along the conveyance path A.

In contrast, a duplex printing process can be illustrated by referring to a conveyance path B in FIG. 1, wherein the paper 15, formed with an image on one side thereof by passing once through the image forming part 20 and the fixing part 30, is conveyed to a duplex printing part 50 by contacting a lower surface of the flapper 40 which is lifted by a solenoid (not shown) disposed inside the main body housing 1. The paper 15 transferred to the duplex printing part 50 is moved again to the image forming part 20 by being reversed through reversing rollers 52 and 54. Here, in the configuration shown in FIG. 1, a plurality of feeding rollers are disposed to convey the paper 15 smoothly along the conveyance paths.

In the case where a jam occurs while the paper 15 is passing through the fixing part 30, the conventional duplex printing apparatus has a significant problem in that it becomes difficult to access and eliminate the paper of the paper jam because the paper is hidden by the flapper 40 provided in the main body 1, or is hidden by the discharging roller 35 combined with the fixing part 30.

Accordingly, a need exists for a system and method to provide a duplex printing apparatus which provides convenient access for eliminating paper jams with greater ease.

SUMMARY OF THE INVENTION

It is an aspect of the present invention to provide a duplex printing apparatus which provides convenient access for eliminating a paper jam without difficulty when a jam occurs while printing.

Additional aspects and advantages of the present invention will be set forth, in part in the description which follows and, in part will be obvious from the description, or may be learned by the practice of the present invention.

The foregoing and other aspects of the present invention are achieved by providing a duplex printing apparatus having a main body housing, an image forming part accommodated in the main body housing for forming images, a fixing part for supplying heat and pressure to a paper, and a duplex printing part to reverse the paper passing through the fixing part on a conveyance path and to guide the paper to the image forming part for duplex printing. The duplex printing apparatus further comprises a flapper to convert the conveyance path of the paper according to whether a duplex printing operation is set, and a discharging roller to discharge the paper from the fixing part. The duplex printing apparatus still further comprises a guide frame comprising a flapper supporting part to rotatably support the flapper, a discharging roller supporting part to rotatably support the discharging roller, and a guide part to guide the paper, wherein the guide frame is detachably disposed between the fixing part and the duplex printing part in the main body housing.

According to an aspect of the present invention, the guide frame comprises an upper guide frame part comprising the flapper supporting part and the guide part, and a lower guide frame part comprising the discharging roller supporting part and which is combined with the upper guide frame part.

According to another aspect of the present invention, the guide frame comprises a bending part at an angle that can be bended or flexed and which extends from both end portions of the guide frame and which further has an elasticity in a direction perpendicular to the surface of the end portions. The bending part further comprises an engagement member to form a projection from the bending part. The main body housing comprises an accommodating member formed having at least one hole or slot disposed in a position that corresponds with the engagement member to allow insertion of the engagement member therein.

According to another aspect of the present invention, the guide frame further comprises an idle roller supporting part to support an idle roller which interacts with the discharging roller to discharge the paper from the fixing part, wherein the idle roller is rotatably supported by the idle roller supporting part.

BRIEF DESCRIPTION OF THE DRAWINGS

The above and other aspects and advantages of the present invention will become apparent and more readily appreciated from the following description of the embodiments, taken in conjunction with the accompanying drawings, of which.

Throughout the drawings, like reference numerals will be understood to refer to like parts, components and structures.

DETAILED DESCRIPTION OF EXEMPLARY EMBODIMENTS

Figure 1:
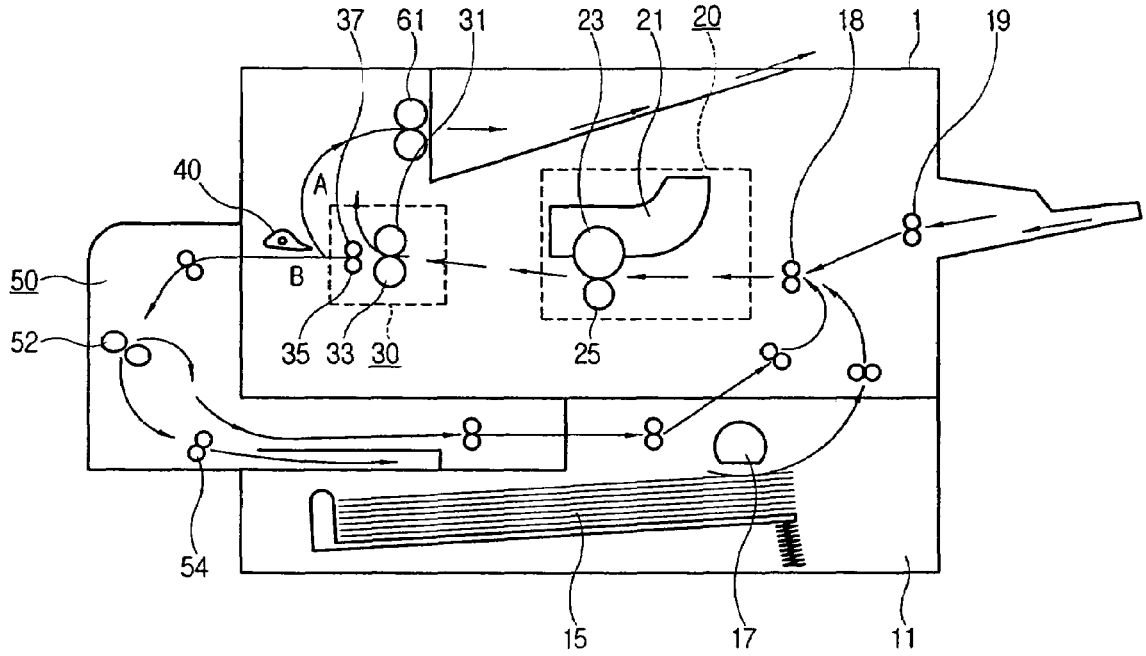
FIG. 1 is a schematic view of an inner configuration of a conventional duplex printing apparatus.

Reference will now be made in detail to embodiments of the present invention, examples of which are illustrated in the accompanying drawings, wherein like reference numerals refer to like elements throughout.

Figure 2:
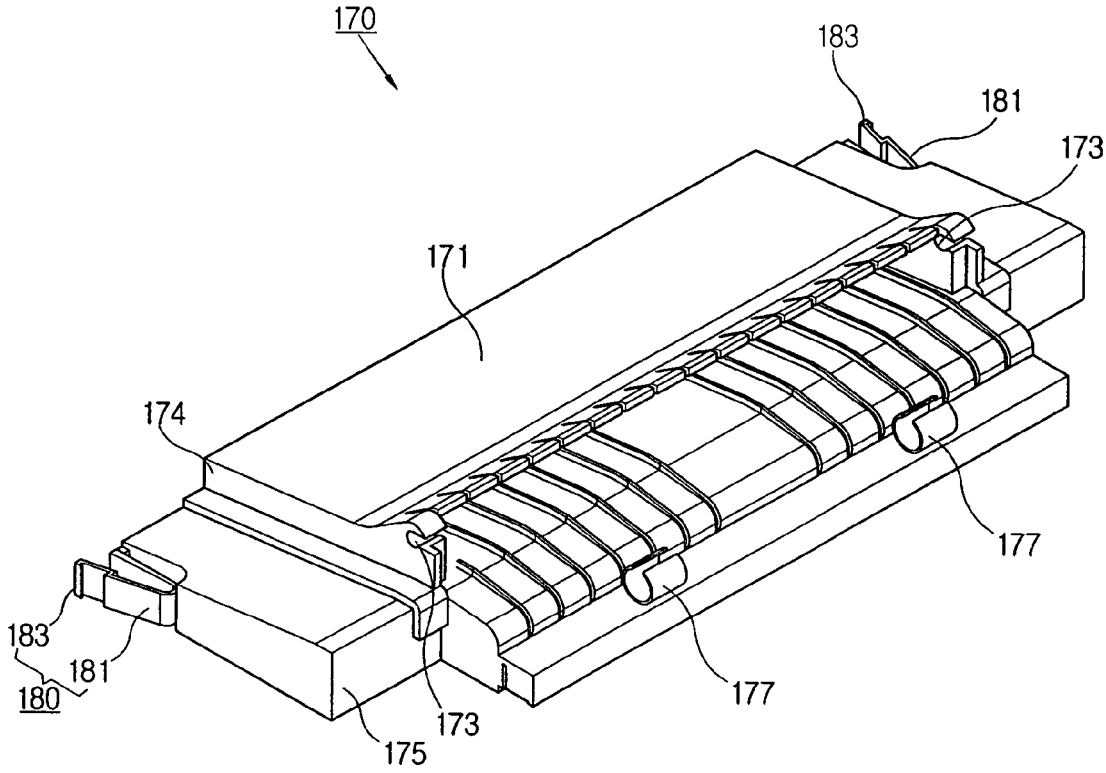
FIG. 2 is a perspective view of a guide frame of a duplex printing apparatus according to an embodiment of the present invention.
Figure 3:
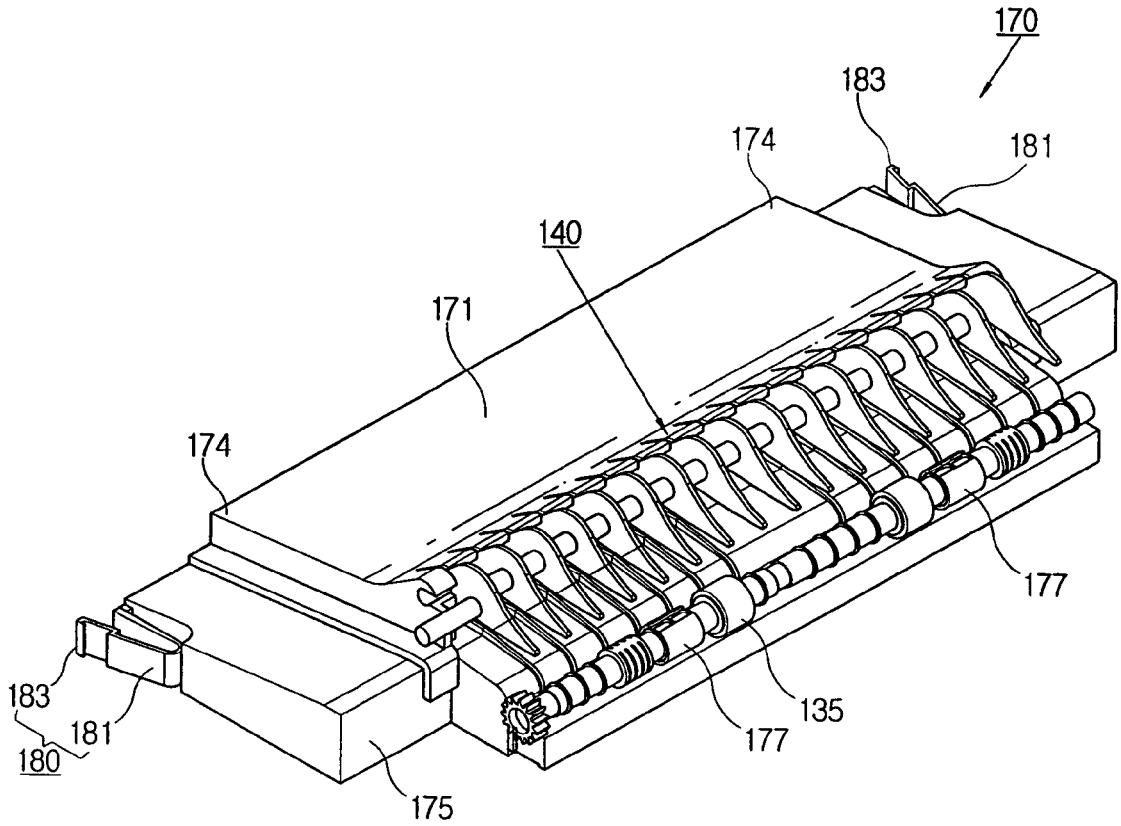
FIG. 3 is a perspective view of a flapper and a discharging roller combined with the guide frame of FIG. 2 according to an embodiment of the present invention.

A configuration of a duplex printing apparatus according to an embodiment of the present invention and a printing process thereof, is described by referring to FIG. 1, FIG. 2, and FIG. 3. As noted above, the conventional duplex printing apparatus comprises a paper feeding part, an image forming part 20, a fixing part 30, a discharging part, and a duplex printing part 50. The paper feeding part comprises a paper feeding cassette 11 for loading a paper 15 on which an image is to be formed, a pick up roller 17 for supplying sheets of the paper 15 one by one, a feeding paper roller 19 to feed paper to the inside of a main body 1 from a paper feeding board disposed on a front surface of the main body 1, and a register roller 18 to line up an end portion of the paper 15.

The image forming part 20 comprises toner as a developer, a developing unit 21 including an attaching part which attaches the toner, an organized photo conductor (OPC) drum 23, and a pre-transfer roller 25 disposed at a lower portion of the OPC drum 23, which creates the image on the paper 15 conveyed from the paper feeding part.

The fixing part 30 comprises a heating roller 31 for applying heat to the paper 15, and a fusing roller 33 for applying pressure on the paper 15, which allows the toner to be completely fixed on the paper 15 by applying the heat and pressure.

The discharging part is provided on the discharging path of the paper 15 passing through the fixing part 30, and comprises a discharging roller 61 for discharging the paper 15 on which both sides or only one side of the paper has been printed with an image, and a discharging board to support and load the discharged paper.

The duplex printing part 50 operates when the duplex printing apparatus is in a duplex printing mode, and comprises reversing rollers 52 and 54 to reverse the paper 15 on the conveyance path, and the feeding roller to guide the feeding of the reversed paper 15.

In the above configuration a plurality of feeding rollers are disposed to convey the paper 15 smoothly along the conveyance paths.

As shown in FIGS. 2 and 3, the duplex printing apparatus according to an embodiment of the present invention further comprises a guide frame 170, which comprises a flapper supporting part 173 to rotatably support a flapper 140, a discharging roller supporting part 177 to rotatably support a discharging roller 135, and a guide part 174 to guide a conveyance of the paper 15. The guide frame 170 can be detachably installed between the fixing part 30 and the duplex printing part 50 within the main body housing 1.

Here, the guide frame 170 can comprise an upper guide frame part 171 including the flapper supporting part 173 and the guide part 174, and a lower guide frame part 175 comprising the discharging roller supporting part 177 and which is coupled with the upper guide frame part 171.

The flapper supporting part 173 is disposed on the upper guide frame part 171 which faces the fixing part 30, and rotatably supports the flapper 140.

As shown in FIG. 2, the upper guide frame part 171 is formed having a bending part disposed on both end parts thereof, and further comprises the guide part 174 which guides the paper 15 passing through the fixing part 30 to the duplex printing part 50 when a duplex printing operation is set. Here, the guide part 174 may be provided with any number of suitable configurations for directing the paper 15 toward the duplex printing part 50. Also, the guide part 174 may be formed having a width sufficient for leaving a gap for the width of the paper 15 so as to not interfere with the conveyance of the paper 15.

The discharging roller supporting part 177 is disposed at a location on the lower guide frame part 175 which faces the fixing part 30, and rotatably supports the discharging roller 135 of the fixing part 30.

The discharging roller supporting part 177 is provided in a circular, or ring shape, of which an upper portion is eliminated from the ring shape as shown FIG. 2 to create an opening allowing insertion of the discharging roller 135. The discharging roller supporting part 177 may be constructed of an elastic material such that a shaft of the discharging roller 135 can be easily inserted via the eliminated portion of the ring by a minimal force. Here, the shape and distribution of the discharging roller supporting part 177 is not limited by the example as described above, but can be provided having other configurations and in appropriate numbers as needed to support the discharging roller 135.

A coupling member 180 can be provided on the lower guide frame part 175 at both end portions thereof where the guide frame 170 faces the duplex printing part 50 to fix the guide frame 170 to the main body housing 1, and to allow easy separation of the guide frame 170 from the main body housing 1.

Here, the coupling member 180 can comprise a bending part 181 at an angle that can be bended or flexed and which extends from both end portions of the lower guide frame part 175, and which can have an elasticity in a direction perpendicular with the surface of the end portions. The coupling member 180 can further comprise an engagement member 183 to form a projection from the bending part 181.

In the main body housing 1, an accommodating member 185 is provided (see FIG. 5) and comprises a number of holes or slots disposed at a position corresponding with the engagement members 183 to receive the insertion of the engagement members 183 therein. Thus, when the guide frame 170 is attached to the duplex printing apparatus according to an embodiment of the present invention, the coupling member 180 fixes the guide frame 170 to the main body housing 1. When the guide frame 170 is detached from the duplex printing apparatus, the engagement members 183 are pushed laterally so that the coupling members 180 are separated from the holes or slots provided in the accommodating member 185 and allow the guide frame 170 to be detached without difficulty.

The guide frame 170 can further comprise an idle roller supporting part (not shown) disposed in the upper guide frame part 171 or in the lower guide frame part 175 for rotatably supporting the idle roller 37 of the fixing part 30 as described in greater detail below. Accordingly, if the guide frame 170 is detachably combined with or removed from the main body housing 1, the idle roller 37 and the discharging roller 135 are also detachably combined with or removed from the main body housing 1.

FIG. 3 is a perspective view of the flapper 140 and the discharging roller 135 combined with the guide frame 170.

The flapper 140 is rotatably supported by the flapper supporting part 173 disposed in the upper guide frame part 171. The flapper 140 converts a paper conveyance path to convey the paper 15 passing through the fixing part 30 along a one sided printing path, or along a duplex printing path, according to whether a user's duplex printing function is set. The flapper 140 is controlled by a solenoid (not shown) disposed inside the main body housing 1. In the case of one sided printing, the paper 15 is output by the discharging roller 61 by rising over and riding along an upper surface of the flapper 140. In the case of duplex printing, the paper 15 is routed into the guide frame 170 by the contact between a lower surface of the flapper 140 and the upper surface of the paper 15, wherein the flapper 140 is lifted and rotated into the routing position by the solenoid.

The discharging roller 135 is rotatably supported by the discharging roller supporting part 177 disposed in the lower guide frame part 175, and discharges the paper 15 from the fixing process of the fixing part 30 by friction with the paper 15. Although not limited to the embodiment shown in FIG. 3, the discharging roller 135 of FIG. 3 has a gear disposed at both end portions of the shaft of the discharging roller 135 which are driven by a plurality of gears of a gear train (not shown) to receive power from a predetermined power supply (not shown) provided in the main body 1.

The idle roller 37 is disposed at an upper portion of the discharging roller 135 and removes the paper 15 from the fixing part 30 by rotating and coming into contact with the discharging roller 135 such that a space is created for the paper 15 therebetween.

Figure 4:
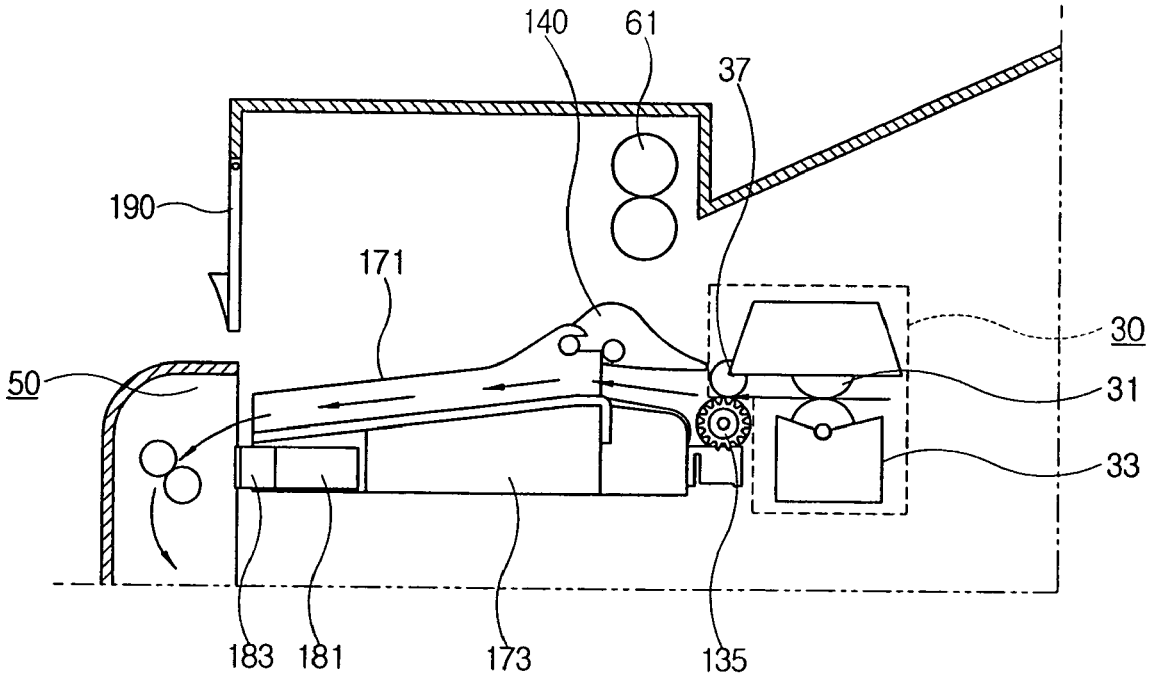
FIG. 4 is a side view of the guide frame of FIG. 2 attached to the duplex printing apparatus of FIG. 1 according to an embodiment of the present invention.

FIG. 4 is a side view of the guide frame 170 when combined with the duplex printing apparatus. As shown in FIGS. 3 and 4, the flapper 140 is rotatably supported by the flapper supporting part 173 disposed in the first side of the upper guide frame part 171. The discharging roller 135 is rotatably supported by the discharging roller supporting part 177 disposed in the first side of the lower guide frame part 175. The guide frame 170 is detachably installed between the fixing part 30 and the duplex printing part 50. The bending part 181 and the engagement part 183 are disposed at both end portions of a second side of the lower guide frame part 175 and fixes the guide frame 170 to the main body housing 1.

In the case of duplex printing, the paper 15 passing through the fixing part 30 is discharged from the fixing part 30 by the discharging roller 135 and the idle roller 37. The paper 15 is then passed by the lower surface of the flapper 140 and is guided to the duplex printing part 50 by the guide part 174 disposed in the upper guide frame part 171.

A rotatable back side door 190 of the main body housing 1 is provided facing an upper portion of the upper guide frame part 171. If the back side door 190 is lifted up, the inside of the duplex printing apparatus is opened.

Hereinbelow, an operating process of the duplex printing apparatus according to an embodiment of the present invention will be described in greater detail by referring to FIGS. 4 and 5.

As shown in FIG. 4, the duplex printing part 50 is provided at the back surface of the duplex printing apparatus to reverse the paper 15 to perform a duplex printing operation. The guide frame part 170 rotatably supports the flapper 140 and the discharging roller 135 between the duplex printing part 50 and the fixing part 30. The back side door 190, further having a knob to rotatably open the door 190 and access the inside thereof, is also disposed in the main body housing 1. Through the above described exemplary embodiment configurations, the duplex printing apparatus can perform a one sided printing or a duplex printing operation.

Figure 5:
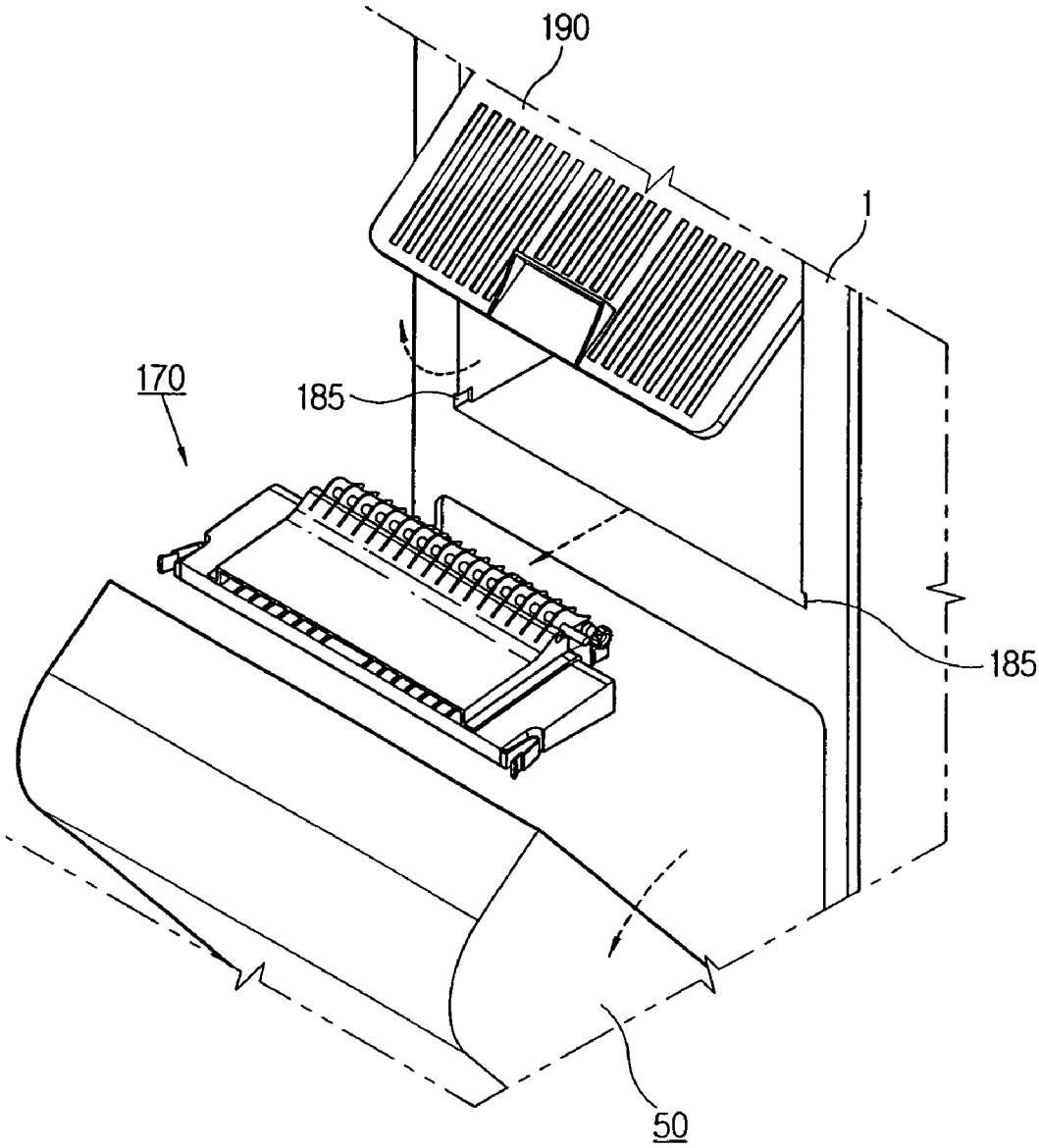
FIG. 5 is a perspective view to illustrate a process for detaching the guide frame of FIG. 2 according to an embodiment of the present invention.

FIG. 5 illustrates a process for easily detaching the guide frame 170 according to an embodiment of the present invention. By referring to FIG. 5, if a jam occurs in the duplex printing apparatus during the printing process, a user can pull the duplex printing part 50 toward the user's direction and the duplex printing part 50 rotates at a predetermined angle and exposes the guide frame 170.

The user can then grip the knob provided in the back side door 190 and lift the back side door 190 up to open the inside of the duplex printing apparatus. After the above steps, the user can laterally push the engagement parts 183 disposed at both end portions of the lower guide frame 175, and separate the engagement parts 183 from the main body housing 1. After the above steps, the guide frame 170 is easily detachable from the main body housing 1. If the guide frame 170 is then separated from the main body housing 1, the heating roller 31 and the fusing roller 33 comprising the fixing part 30 are opened to the outside. Thus, the user can eliminate the jammed paper 15 hanging on the fixing part 30 without difficulty.

After the jammed paper 15 is eliminated, the guide frame 170 can again be combined with the main body housing 1, and the engagement part 183 provided in the guide frame 170 can be secured by inserting each within the corresponding holes or slots disposed in the accommodating part 185 of the main body housing 1. Also, after the back side door 190 is rotated and closed, and the duplex printing part 50 is rotated and secured to the main body housing 1, the duplex printing apparatus is ready to print again.

Although a number of exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A duplex printing apparatus, having a main body housing, an image forming part accommodated in the main body housing for forming images, a fixing part for supplying heat and pressure to a paper, and a duplex printing part to reverse the paper passing through the fixing part on a conveyance path and to guide the paper to the image forming part for duplex printing, the duplex printing apparatus comprising:

a flapper to convert the conveyance path of the paper according to whether a duplex printing operation is set;

a discharging roller to discharge the paper from the fixing part; and a guide frame comprising a flapper supporting part to rotatably support the flapper, a discharging roller supporting part to rotatably support the discharging roller, and a guide part to guide the paper, wherein the guide frame is detachably disposed between the fixing part and the duplex printing part in the main body housing.

2. The duplex printing apparatus according to claim 1, wherein the guide frame further comprises;

an upper guide frame part comprising the flapper supporting part and the guide part; and a lower guide frame part comprising the discharging roller supporting part.

3. The duplex printing apparatus according to claim 1, wherein the guide frame further comprises:

end portions disposed at opposite ends of the guide frame;

an angled bending part extending from both end portions of the guide frame and having an elasticity in a direction perpendicular to the end portions of the guide frame, and an engagement member to form a projection from the bending part.

4. The duplex printing apparatus according to claim 3, wherein the main body housing comprises:

an accommodating member comprising at least one hole disposed in a position corresponding with the engagement member to allow insertion of the engagement member therein.

5. The duplex printing apparatus according to claim 3, wherein the main body housing comprises:

an accommodating member comprising at least one slot disposed in a position corresponding with the engagement member to allow insertion of the engagement member therein.

6. The duplex printing apparatus according to claim 2, wherein the guide frame further comprises:

end portions disposed at opposite ends of the lower guide frame part;

an angled bending part extending from both end portions of the lower guide frame part and having an elasticity in a direction perpendicular to the end portions of the lower guide frame part, and an engagement member to form a projection from the bending part.

7. The duplex printing apparatus according to claim 6, wherein the main body housing comprises:

an accommodating member comprising at least one hole disposed in a position corresponding with the engagement member to allow insertion of the engagement member therein.

8. The duplex printing apparatus according to claim 6, wherein the main body housing comprises:

an accommodating member comprising at least one slot disposed in a position corresponding with the engagement member to allow insertion of the engagement member therein.

9. The duplex printing apparatus according to claim 1, wherein the guide frame further comprises:

an idle roller supporting part to rotatably support an idle roller to engage with the discharging roller to discharge the paper from the fixing part.

10. A method of providing access to a fixing unit in a duplex printing apparatus, having a main body housing, an image forming part accommodated in the main body housing for forming images, a fixing part for supplying heat and pressure to a paper, and a duplex printing part, comprising the steps of:

providing a guide frame for rotatably securing at least one of a flapper, a fixing part discharging roller, and a fixing part idle roller; and removably securing the guide frame to the duplex printing apparatus between a fixing part and a duplex printing part, wherein access to the fixing unit is provided when the guide frame is removed.

11. The method according to claim 10, further comprising the step of:

providing at least one flexible engagement member extending from the guide frame to removably secure the guide frame to the duplex printing apparatus.

12. The method according to claim 11, further comprising the step of:

accessing the guide frame secured to the duplex printing apparatus between a fixing part and a duplex printing part using a door disposed in the duplex printing apparatus.

* * * * *